US005375631A

United States Patent [19]

Mochizuki

[11] Patent Number: 5,375,631

[45] Date of Patent: Dec. 27, 1994

[54] CORE MATERIAL CONTAINER USED FOR VACUUM HEAT INSULATORS AND CORE-MATERIAL CHARGING DEVICE AS WELL AS CHARGING METHOD THEREOF

[75] Inventor: Hitoshi Mochizuki, Yamatokoriyama, Japan

[73] Assignee: Sharp Kabushiki Kaisha, Osaka, Japan

[21] Appl. No.: 26,577

[22] Filed: Mar. 5, 1993

[30] Foreign Application Priority Data

Apr. 27, 1992 [JP] Japan ..... 4-107794

[51] Int. Cl.[5] ..... B65B 1/04

[52] U.S. Cl. ..... 141/7; 141/10; 141/51; 141/59; 141/65; 141/67; 141/114; 141/286; 141/313; 222/444

[58] Field of Search ..... 141/1, 4, 5, 7, 8, 10, 141/51, 59, 65, 67, 68, 114, 286, 301, 302, 305, 310, 313–317; 220/444

[56] References Cited

U.S. PATENT DOCUMENTS

| | | | |
|---|---|---|---|
| 2,477,044 | 7/1949 | Carmean | 141/51 X |
| 2,765,816 | 10/1956 | Carter | 141/315 X |
| 2,780,247 | 2/1957 | Claassen, Jr. | 141/114 X |
| 2,815,621 | 12/1957 | Carter | 141/7 X |
| 3,605,826 | 9/1971 | Carter | 141/286 X |
| 3,911,972 | 10/1975 | Hubers et al. | 141/7 |

FOREIGN PATENT DOCUMENTS

| | | | |
|---|---|---|---|
| 32081 | 6/1989 | Japan . | |
| 3176306 | 7/1991 | Japan | 141/10 |
| 4311403 | 11/1992 | Japan | 141/114 |
| 351397 | 12/1992 | Japan . | |

*Primary Examiner*—J. Casimer Jacyna

[57] ABSTRACT

A core-material container constituted of a container main body whose opening is covered with a sheet-like lid member made of an air-permeable material. In order to charge powder core material through a core-material charging inlet uniformly as well as densely, the charging operation of the core material is carried out in the following manner: housing the core material container in a housing space formed by a positioning guide and a plate member; releasing air from a suction outlet, thereby making the core-material charging inlet adhere around a nozzle; releasing air located inside a sealed space enclosed by an upper frame and a lower frame through an air outlet; and charging the core material through the nozzle while evacuating the core material container. Thus, the core material is uniformly charged by air flows caused by the air release, and the charge is densely carried out since air contained in the core material is removed.

21 Claims, 6 Drawing Sheets

CORE MATERIAL CONTAINER USED FOR VACUUM HEAT INSULATORS AND CORE-MATERIAL CHARGING DEVICE AS WELL AS CHARGING METHOD THEREOF

FIELD OF THE INVENTION

The present invention relates to a core material container for a vacuum heat insulator used for refrigerators or other appliances and to a core-material charging device and its charging method with respect to the core material container. More specifically, the core material container, the core-material charging device and the core-material charging method are provided for charging powder, such as pearlite used as the core material, into the core material container uniformly as well as densely.

BACKGROUND OF THE INVENTION

A vacuum heat insulator, which is buried into a wall of a refrigerator or other appliance to form an insulated wall, is produced in the following manner: First, inorganic powder such as pearlite or organic powder such as pulverized powder of hard urethane foam, which is used as a core material, is densely charged into an air-permeable core-material container bag made of kraft paper or other material. Next, the core-material container bag filled with the core material is housed in a bag made of resin film whereon aluminum vapor deposition or metallic foil laminate is applied and which has superior gas-barrier properties, and then air is removed from the bag so that it is made into a vacuum heat insulator. Conventionally, in order to prepare the core-material container bag filled with the core material, powder such as pearlite is weighed and charged into a core-material container bag made of kraft paper or other material, and after sealing the charging inlet, the bag is manually flattened and then pressurized by a press so as to remove air thereform. Thus, the density of the charged core material is increased.

However, the above-mentioned conventional method has the following problems: Since the volume of the powder before being charged into a core-material container bag and pressurized therein is several times as large as that of the powder after pressurized, a quite large core-material container bag needs to be prepared in comparison with the size of the bag after pressurized. This results in a waste of material, and causes wrinkles over the core-material container bag and areas that do not have sufficient core material due to the difference in sizes before and after the pressurization. Further, since it is hard to charge the core material into the core-material container bag uniformly as well as densely by the manual flattening operation, recessed portions and raised portions are inevitably made. Moreover, powder such as pearlite tends to be scattered during charging, thereby contaminating the working space and giving adverse effects to the worker's health.

SUMMARY OF THE INVENTION

The primary object of the present invention is to provide an air-permeable core material container and a charging device as well as a charging method for use therewith, which are well suited for charging core material in powder into the core material container uniformly as well as densely.

In order to achieve the above object, the core material container in accordance with the present invention has at least the following means:

(a) a flat, tray-like container main body for housing a core material;

(b) a lid member for covering an upper opening of the container main body, the lid member being made of an air-permeable material having a sheet-like shape with a core-material charging inlet formed thereon; and (c) a suction member that is made of a non-air-permeable material so as to be sucked by air-suction, the suction member being provided around the core-material charging inlet of the lid member.

In accordance with the above arrangement, the core-material charging inlet is formed in the center of the lid member made of an air-permeable material. Therefore, since the incoming core material is equally charged by flows of air that are released through all the surface of the air-permeable lid member, the charging operation of the core material is executed uniformly throughout the core-material container. Further, since the core-material charging inlet is provided in the center of the lid member, the core material container is readily installed in the core-material charging device without taking account of directions in which it is positioned, thereby making it possible to improve efficiency of the work. Moreover, the suction member, made of a non-air-permeable material, is provided around the core-material charging inlet that is formed in the air-permeable lid member. Here, the lid member is made of non-woven fabric or the like and has flexibility and the suction property is improved around the core-material charging inlet by installing the suction member. Therefore, when the suction member is sucked by a vacuum suction means that is installed around a core-material charging nozzle of the core-material charging device, the surrounding area of the core-material charging inlet is adhered to the suction means, thereby preventing the core material from being scattered outside the core material container.

Further, in order to achieve the above object, the core-material charging device of the present invention has at least the following means:

(d) a positioning guide for positioning and housing the core material container at a predetermined location;

(e) a plate member for forming a housing space for the core material container in cooperation with the positioning guide, the plate member being provided with air-vent pores that reach the housing space;

(f) a lower frame for fixing the positioning guide;

(g) an upper frame for fixing the plate member and for housing the positioning guide and the plate member inside a sealed space that is formed between the upper frame and the lower frame, the upper frame being removably attached to the lower frame;

(h) a core-material charging nozzle that is inserted into the core-material charging inlet of the core material container located in the housing space so as to charge the core material into the core material container;

(i) air-release means for releasing air from the sealed space enclosed by the upper and lower frames, the air-release means being connected to an air outlet formed in the upper frame; and (j) suction means for sucking air in such a manner that the suction member of the core material container is sucked toward, and adhered to the plate member.

In the above arrangement, a housing space for the core material container is formed by the positioning guide and the plate member inside the sealed space that is enclosed by the upper and lower frames. Thus, the core material container is placed on the positioning guide with the core-material charging inlet facing the plate member. The positioning guide is formed into a shape that corresponds to the shape of the core material container, and is replaceable on demand so as to fit the shape of the core material container to be used. The suction member disposed around the core-material charging inlet of the core material container is sucked and adhered to the surrounding area of the core-material charging nozzle as the suction means is operated. When air contained inside the sealed space between the upper and lower frames is released by the air-release means, air inside the core material container is released through the plate member having an air-permeable structure; thus, the core material container is adhered to the plate member, and expanded.

In this state, if an air inlet installed at the installation station of the core-material charging nozzle is kept open, the core material container will be expanded more effectively, since external air is directed into the core material container as the air-release process is carried out therein. While executing the suction operation of the core-material charging inlet of the core material container and the air-release operation of the core material container, the core-material charging nozzle is inserted into the core-material charging inlet and the core material is charged. Thus, the core material is carried with air flows caused by the air-release operation, and uniformly charged throughout the core material container. Further, since air contained in the core material is removed, the core material is charged densely. Moreover, the height of the housing space of the core material container, which is determined by the positioning guide and the plate member, is set to be slightly greater than the dimensional height of the core material container. This results in more expansion in the core material container, thereby increasing the amount of charging.

Moreover, in order to achieve the above object, the core-material charging method of the present invention has the following steps of:

(k) housing the core material container on the positioning guide, combining the upper and lower frames, and then sucking the suction member of the core material container by using the suction means so that the suction member adheres to the plate member;

(l) releasing air contained in the sealed space enclosed by the upper and lower frames through the air outlet by using the air-release means and thus making the core material container adhere to the plate member and the positioning guide by which the housing space is formed;

(m) inserting the core-material charging nozzle into the core-material charging inlet of the core material container and charging the core material thereto;

(n) stopping the air-release operation of the air-release means after the completion of the charging process; and (o) stopping the suction operation of the suction means, thereby releasing the suction member from its adhered state onto the plate member.

In accordance with the above method, the charging operation of the core material is executed in the following manner: placing the core material container on the positioning guide; sucking the suction member of the core material container by using the suction means so that it adheres to the plate member after combining the upper and lower frames; releasing air contained in the sealed space enclosed by the upper and lower frames through the air outlet by using the air-release means as well as making the core material container adhere to the plate member and the positioning guide forming the housing space by expanding the core material container using air flowing thereinto from the air inlet; inserting the core-material charging nozzle into the core-material charging inlet of the core material container and charging the core material thereto; stopping the air-release operation of the air-release means after the completion of the charging process; and stopping the suction operation of the suction means, thereby completing the charging operation. By executing the above processes with predetermined time intervals, the core material container is expanded, and allowed to be charged with the core material uniformly as well as densely.

In this core-material charging method, the vacuum degree in the suction means is set to be greater than that in the air release of the air-release means. This arrangement ensures that the surrounding area of the core-material charging inlet is sucked and constantly adhered around the core-material charging nozzle. Thus, the charging is carried out without scattering of the core material. Further, by adjusting the vacuum degree of the air release from the air-release means, the release of air contained in the core material is varied; therefore, the charging amount of the core material is adjustable by adjusting the vacuum degree. Since the core-material charging amount is kept virtually constant with a set value of the degree of vacuum, a predetermined amount of core material charge can be deposited without weighing the charging amount of the core material by maintaining the degree of vacuum at a predetermined value.

For a fuller understanding of the nature and advantages of the invention, reference should be made to the ensuing detailed description taken in conjunction with the accompanying drawings which are given by way of illustration only, and thus are not limitative of the present invention.

BRIEF DESCRIPTION OF THE DRAWING

FIG. 5(*b*) shows that the core-material charging amount can be increased with respect to the core material container 10;

FIG. 6(*b*) shows a perspective view of another container main body which features grooves with respect to the core material container.

DESCRIPTION OF THE EMBODIMENTS

Referring to the attached drawings, the following description will discuss one embodiment of the present invention so as to disclose the present invention. Here, the embodiment is merely one example of the embodiments of the present invention, and the technical scope of the present invention is not intended to be limited thereby.

Figure 1:
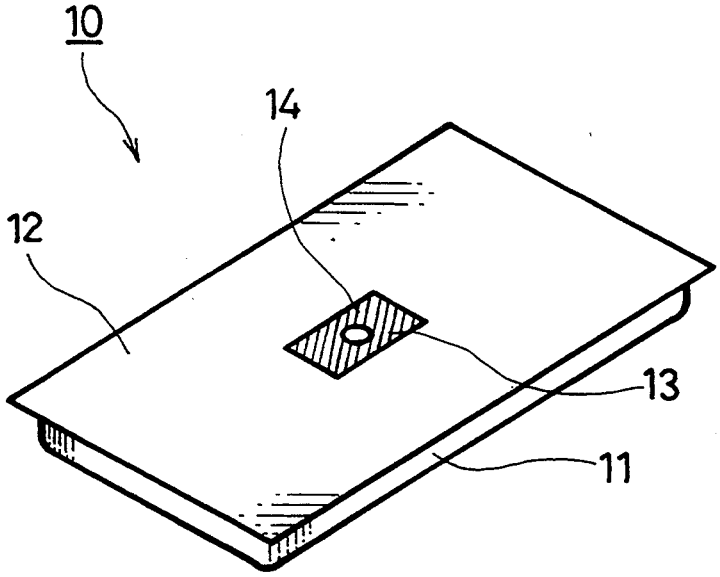
FIG. 1 is a perspective view showing a core material container in accordance with an embodiment of the present invention.
Figure 2:
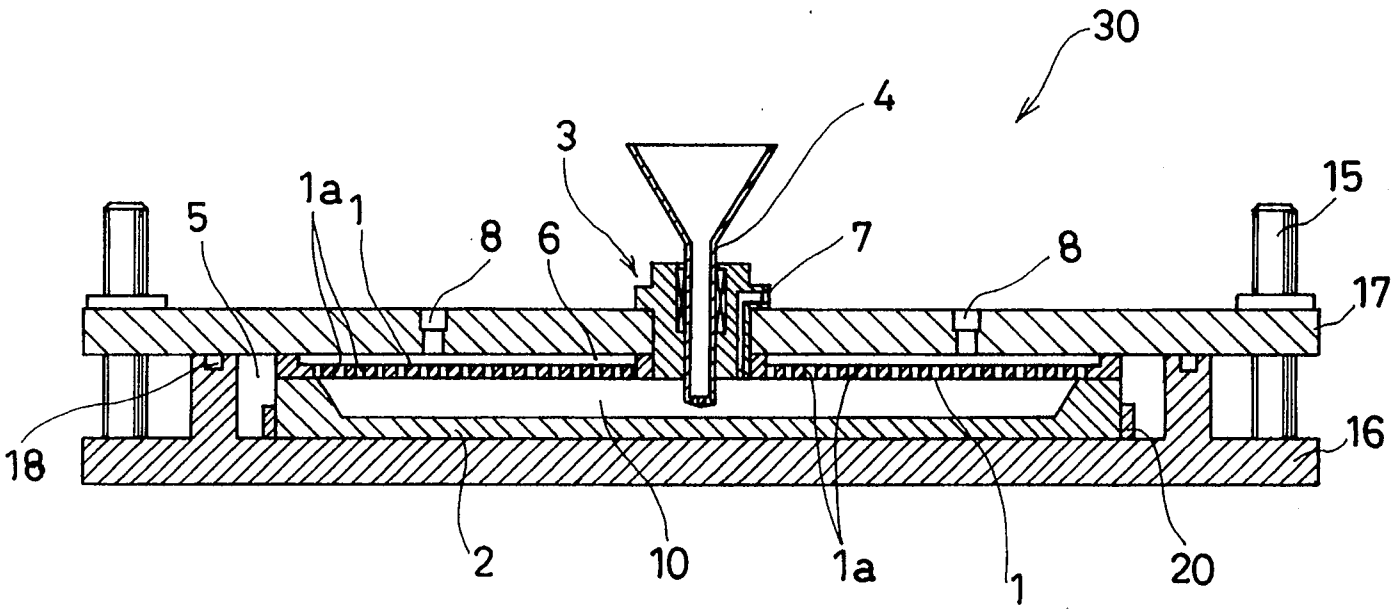
FIG. 2 is a sectional view showing a structure of a core material charging device in accordance with the embodiment of the present invention.
Figure 3:
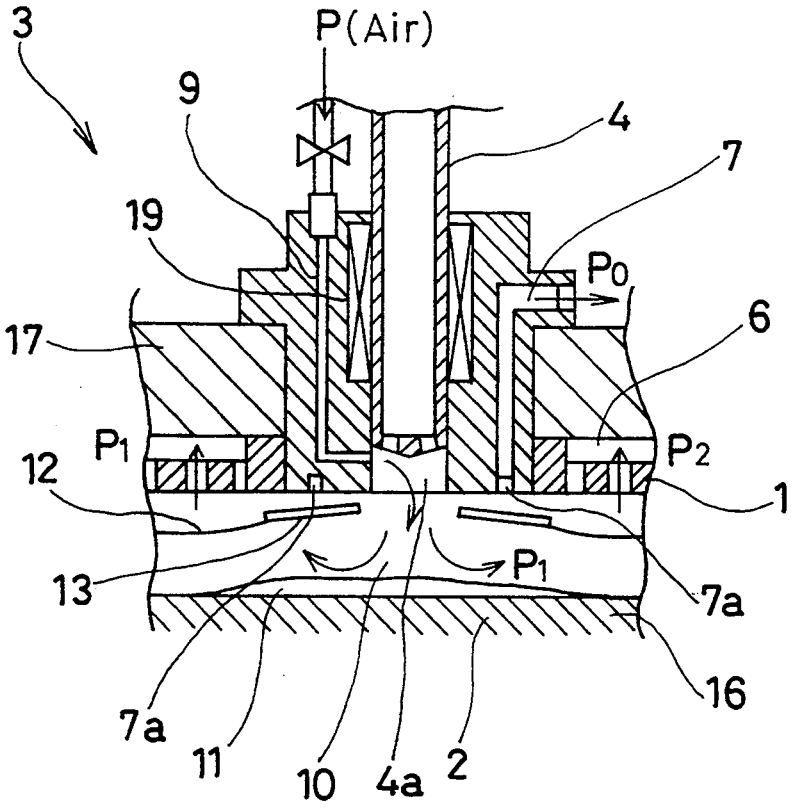
FIG. 3 is an enlarged sectional view showing a structure of a suction means employed in the core material charging device of the embodiment.
Figure 4:
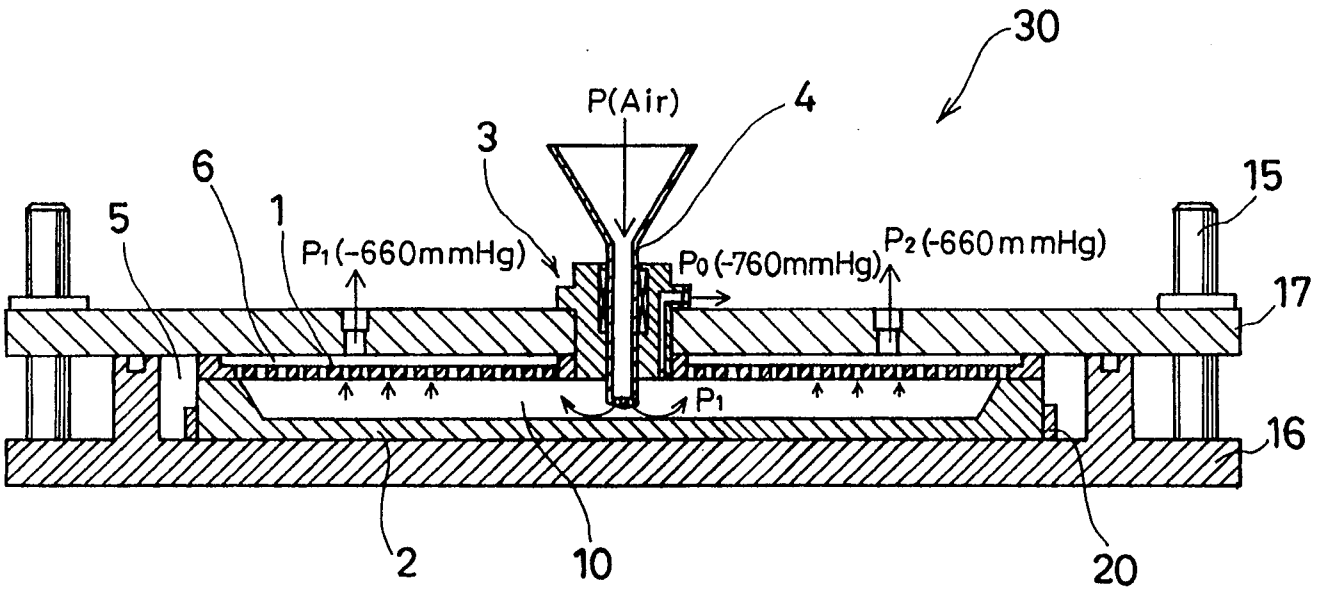
FIG. 4 is an explanatory drawing illustrating degrees of vacuum and air flows that are caused by the air release of the embodiment.
Figure 5A:
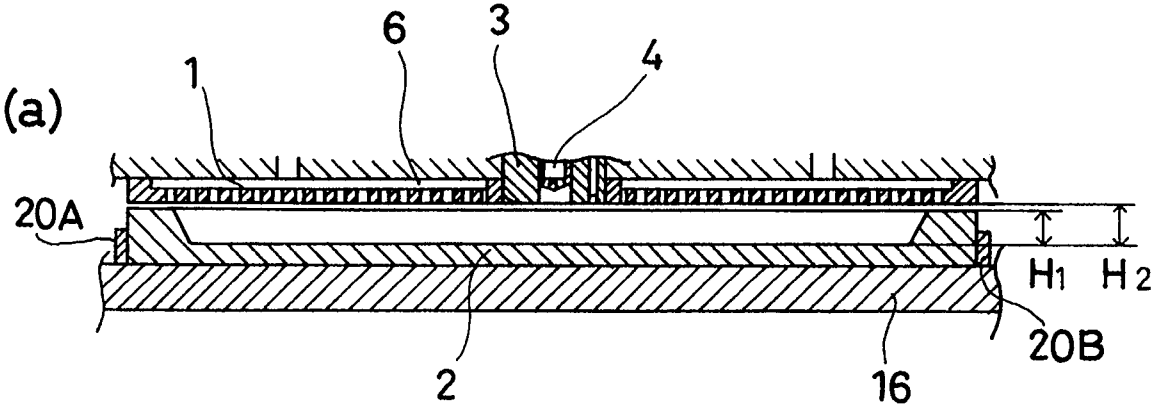
FIG. 5(*a*) is a sectional view illustrating an arrangement of the core material container of the embodiment when the core material of an increased charging amount is applied thereto.
Figure 5B:
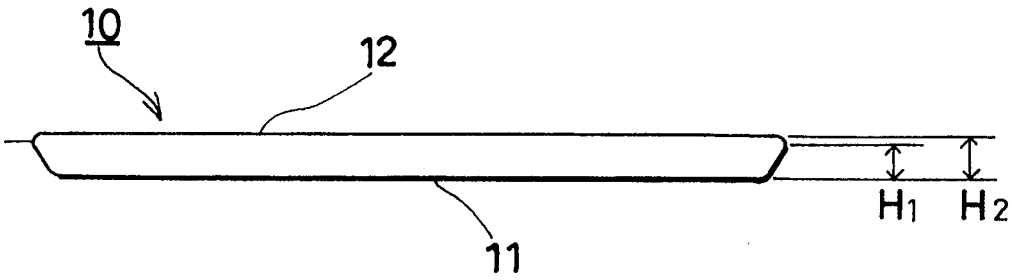
Figure 6A:
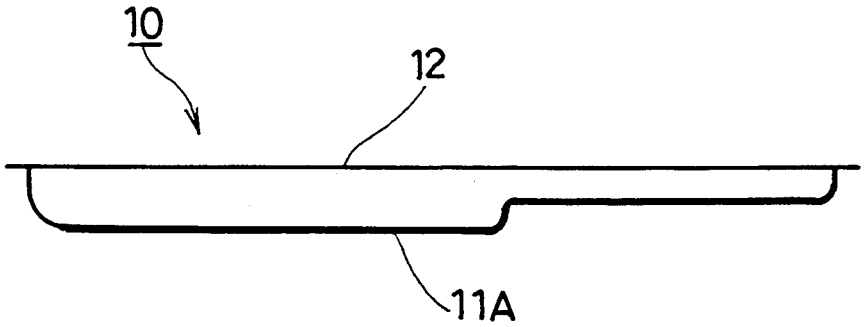
FIG. 6(*a*) shows a perspective view of a container main body which features a single step with respect to the core material container.
Figure 6B:
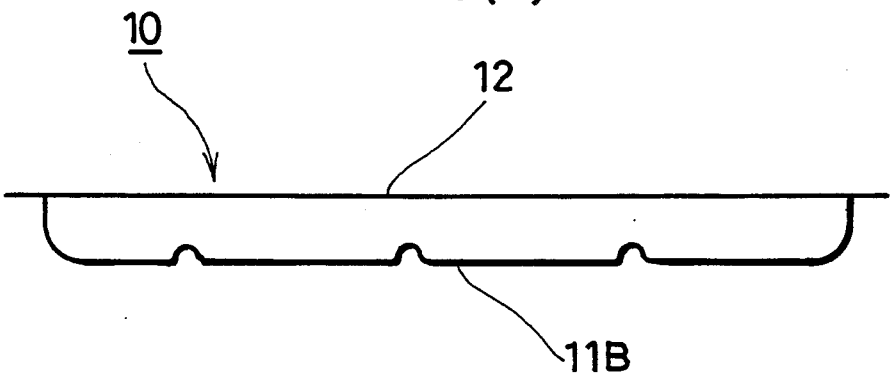

FIG. 1 is a perspective view showing a core material container in accordance with this embodiment of the present invention. FIG. 2 is a sectional view showing the structure of a core-material charging device in accordance with the embodiment of the present invention. FIG. 3 is an enlarged sectional view showing a structure of a suction means. FIG. 4 is an explanatory drawing illustrating degrees of vacuum and air flows that are caused by the air release. FIG. 5 is a sectional view illustrating an arrangement of the core material container wherein the height of the storing space of the core material container is varied. FIG. 6(*a*) and FIG. 6(*b*) respectively show perspective views of a container main body, which features a single step, and another container main body which features grooves, with respect to the core material container.

As illustrated in FIG. 1, a core material container 10 is constituted of a container main body 11, which is molded from resin into a flat, thin tray-like shape, and a lid member 12, which covers the opening of the core-material containing component and which is joined thereto such that its peripheral edges are connected to those of the container main body 11. The lid member 12 is made of a material having air permeability, such as nonwoven fabric, kraft paper and cloth, and provided with a core-material charging inlet 14 in the center thereof. Further, a suction member 13, which is made by affixing a flat-surface resin sheet thereto or by impregnating a resin material thereto so as to obviate the air permeability, is provided around the core-material charging inlet 14.

As described above, the core-material charging inlet 14 is provided in the center of the lid member 12 of the core material container 10, and the diameter thereof is made 5–10 mm larger than that of a core-material charging nozzle 4 which is to be inserted to the inlet 14. Therefore, when the core material container 10 is attached to a core-material charging device 30, which will be described later, it is readily installed in the core-material charging device 30 without taking account of directions in which it is positioned, thereby making it possible to improve efficiency of the installation work. Thus, better positional comformity is provided between the inlet 14 and the core-material charging nozzle 4, and the core material is uniformly filled throughout the core material container 10. Moreover, since the surrounding area of the core-material charging inlet 14 is furnished as the suction member 13 and since it is not air-permeable, it is sucked, and adhered around the core-material charging nozzle 4 when the core material is filled by the core-material charging device 30. This arrangement prevents the incoming core material from being scattered outside the core material container 10. Here, an adhering property of the surrounding area of the core-material charging inlet 14 is further improved by providing the non-air-permeable suction member 13.

In order to fill the core material uniformly as well as densely into the core material container 10 that has the above arrangement, the core-material charging device 30 as shown in FIG. 2 is employed.

As illustrated in FIG. 2, the core-material charging device 30 is constituted of an upper frame 17 and a lower frame 16, both of which are positioned by guide pins 15 so as to be separated from each other or joined together. Since a rubber member 18 is provided at the contacting portion between the lower frame 16 having a U-shape in its cross-section and the upper frame 17, a sealed-space 5 is formed by the upper frame 17 and the lower frame 16 when they are joined together. A positioning guide 2 is placed on the lower frame 16 inside the sealed space 5 with its position determined by guide bars 20.

The positioning guide 2 is provided with a recessed section in which the core material container 10 is housed. By replacing the positioning guide 2, the shape of this recessed section is changeable on demand so as to meet the size and shape of a core material container 10 to be used, as is illustrated in FIG. 6. A plate member 1, which has a number of air-vent pores 1*a* formed therethrough, is attached to the positioning guide 2 by the sealed space 5 side of the upper frame 17 that faces the positioning guide 2; thus, a housing space for the core material container 10 is formed between the plate member 1 and the positioning guide 2. An air-release tunnel 6 is thus formed between the plate member 1 and the upper frame 17, and connected to an air outlet 8 that penetrates through the upper frame 17. The air outlet 8 is connected to an air-release means, not shown. Further, a suction means 3 having a core-material charging nozzle 4 is attached to the central portion of the upper frame.

As illustrated in an enlarged manner in FIG. 3, the suction means 3 is constructed such that the core-material charging nozzle 4 is located at the center thereof. The core-material charging nozzle 4 is supported by a slide bearing 19, and capable of moving forward and backward. A suction groove 7*a* is formed around an incoming-air adjustable hole 4*a* for the core-material charging nozzle 4, and a duct is provided for connecting the suction groove 7*a* and a suction outlet 7. A suction-use air-release means, not shown, is connected to the suction outlet 7. Further, an air inlet 9 is provided with its opening formed inside the incoming-air adjustable hole 4*a* for the core-material charging nozzle 4.

The charging operation of the core material is carried out by the core-material charging device 30 having the above-mentioned arrangement as follows: First, the upper frame 17 is removed from the guide pins 15, and the core material container 10 of FIG. 1 is housed in the positioning guide 2 with the lower frame 16 opened. By attaching the upper frame 17, the core material container 10 is situated inside the housing space enclosed by the positioning guide 2 and the plate member 1. The charging operation of the core material is carried out in the following manner: releasing air from the suction outlet 7; releasing air from the air outlet 8; inserting the core-material charging nozzle 4 into the core material container 10; and charging the core material from the core-material charging nozzle 4. These processes are executed with predetermined time intervals. After charging the core material, the operation is completed in the following manner: stopping the charging of the core material from the core-material charging nozzle 4; stopping the release of air from the air outlet 8; and stopping the release of air from the suction outlet 7.

These processes are also executed with predetermined time intervals.

FIG. 4 shows the difference in degree of vacuum between air released from the suction outlet 7 and the air outlet 8 as well as showing the released-air flows. Here, in this embodiment, during the air-releasing operation, the degree of vacuum $P_0$ of air released from the suction outlet 7 is set to −760 mmHg, and the degree of vacuum $P_1$ and $P_2$ of air released from the air outlet 8 is set to −660 mmHg. By providing such a difference in degree of vacuum, the suction member 13 of the core material container 10 always adheres to the suction means 3 positively by means of vacuum suction. Thus, this arrangement prevents troubles such as adhesion trouble caused by gas impact during the charging operation of the core material, as well as preventing the incoming core material from being scattered outside the core material container 10.

In the air-releasing operation as described above, air located inside the core material container 10 flows from the air-permeable lid member 12 to the air outlet 8 through the air-vent pores 1*a* of the plate member 1 and the air-release tunnel 6*a*; therefore, the core material container 10 is expanded by air flowing thereto from the core-material charging nozzle 4, thereby making the lid member 12 adhere to the plate member 1. In this state, if the air inlet 9 installed in the suction means 3 is opened, the expansion of the core material container 10 will be accelerated by air flow from the air inlet 9, and the air pressure inside the core material container will increase; thus, better suction property is provided between the suction member 13 and the suction means 3.

While continuing the above-mentioned air-releasing operation, the core-material charging nozzle 4 is advanced, and inserted into the core material container 10, thereby starting the supply of the core material. Thus, the core material, which flows together with air contained therein, is delivered and densely deposited throughout the inside of the expanded core material container 10. In this case, since the vacuum suction is operated, greater suction force is exerted at portions where lesser amounts of the core material have accumulated. Therefore, the filling is preferentially made in areas that do not have sufficient core material, thereby permitting the core material to be uniformly filled inside the core material container 10.

The degree of vacuum $P_1$ and $P_2$ of air released from the air outlet 8, which is shown in FIG. 4, is set to a desired value by adjusting a relief valve on a vacuum pump that functions as an air-release means connected to the air outlet 8. The core material is carried by air flows caused by the air-releasing operation, and accumulated inside the core material container 10, while air contained in the core material is released and eliminated. Therefore, the core-material charging density and the core-material charging amount can be varied in proportion to the degree of vacuum. Since the core-material charging amount is kept virtually constant with a set value of the degree of vacuum, a predetermined amount of core material charge can be deposited without weighing the charging amount of the core material by maintaining the degree of vacuum at a predetermined value.

Further, as illustrated in FIG. 5(*a*), when height $H_2$ of the housing space of the core material container 10 formed between the positioning guide 2 and the plate member 1 is set to be greater than height $H_1$ of the core material container 10, the core-material charging amount can be increased with respect to the core material container 10 as is indicated by FIG. 5(*b*). After the charging operation of the core material, the core material container 10 is stored in a bag that is made of resin film having gas-barrier properties, and then the air is removed so as to be made into a vacuum heat insulator in its finished stage. In this case, since the degree of vacuum inside the bag of the vacuum heat insulator is maintained at not more than 1 mmHg, atmospheric pressure of approximately 1 kg/cm$^2$ is applied thereonto. When the charging amount is increased to compensate for any shrinkage due to atmospheric pressure, the height of the core-material housing space is increased as is described earlier. The increased charging amount for compensating for the shrinkage due to the atmospheric pressure is obtained by setting height $H_2$ of the housing space of the core material container 10 to be as great as $H_2$=(the core material density/the core material charging density)×$H_1$.

Further, the air inlet 9 of the suction means 3, which is used for boosting the expansion of the core material container 10 by opening it during air release from the core material container 10, as was described earlier, is also used for removing and cleaning residual core material that adheres around the opening and in the adjustable hole 4*a* for incoming air of the core-material charging nozzle 4 by introducing air therethrough after the core material has been filled.

In the above embodiments, the core material container 10 that is constituted of the container main body 11 and the lid member 12, as shown in FIG. 1, was used as an example; yet, a bag-like container made of kraft paper or the like may be employed as the core material container 10. In that case, by replacing the positioning guide 2 of the core-material charging device 30 with a suitable one, the corresponding modification can be made.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A core-material charging device, which charges core material in powder uniformly as well as densely into a core material container, the core material container being made of an air-permeable material and provided with a core-material charging inlet and non-air-permeable suction member formed around the core-material charging inlet, comprising:

a positioning guide for positioning and housing the core material container at a predetermined location;

a plate member for forming a housing space for the core material container in cooperation with the positioning guide, the plate member being provided with air-vent pores that reach the housing space;

a lower frame for fixing the positioning guide;

an upper frame for fixing the plate member and for housing the positioning guide and the plate member inside a sealed space that is formed between the upper frame and the lower frame, the upper frame being removably attached to the lower frame;

a core-material charging nozzle that is inserted into the core-material charging inlet of the core material container located in the housing space so as to charge the core material into an interior of the core material container, an opening being provided in the plate member through which the core material is moved during charging by the core-material charging nozzle;

air-release means for releasing air from the sealed space enclosed by the upper and lower frames, the air-release means being connected to an air outlet formed in the upper frame, the air release means and air outlet placing the sealed space and the interior of the core material container under a vacuum at a first vacuum pressure; and suction means for sucking air at a second vacuum pressure in such a manner that the suction member of the core material container is sucked toward, and adhered to the plate member, the second vacuum pressure of the suction means being greater than the first vacuum pressure of the air-release means.

2. The core-material charging device as set forth in claim 1, wherein an air inlet is installed at an installation station of the core-material charging nozzle so as to introduce air into the core material container that is located in the housing space, the air inlet being arrange to be freely opened and closed.

3. The core-material charging device as set forth in claim 1, wherein the housing space has a height that is slightly greater than the dimensional height of the core material container.

4. The core-material charging device as set forth in claim 1, further comprising:

guide pins for attaching the upper frame to the lower frame in an adjustable manner in vertical directions and for positioning the upper frame with respect to the lower frame, taking account of a jointed condition therebetween.

5. The core-material charging device as set forth in claim 1, further comprising:

a rubber member for sealing a space between the upper and lower frames, the rubber member being sandwiched by the upper and lower frames that are joined together.

6. The core-material charging device as set forth in claim 1, further comprising:

a slide bearing for attaching the core-material charging nozzle to the upper frame in an adjustable manner in vertical directions.

7. The core-material charging device as set forth in claim 1, wherein:

the suction means comprises:

a suction groove that is formed so as to face the suction member of the core material container housed in the housing space;

a suction outlet that is formed in an installation station of the core-material charging nozzle so as to be connected to the suction groove through a duct; and suction-use air-release means that is connected to the suction outlet so as to release air from the housing space.

8. The core-material charging device as set forth in claim 1, wherein the positioning guide is formed into a shape corresponding to the shape of the core material container, and removably attached to the lower frame.

9. The core-material charging device as set forth in claim 8, further comprising:

a guide bar for positioning and fixing the positioning guide on the lower frame.

10. A charging method for use with the core-material charging device as set forth in claim 3, comprising the steps of:

housing the core material container on the positioning guide, combining the upper and lower frames, and then sucking the suction member of the core material container by using the suction means so that the suction member adheres to the plate member;

releasing air contained in the sealed space enclosed by the upper and lower frames through the air outlet by using the air-release means and thus making the core material container adhere to the plate member and the positioning guide forming the housing space;

inserting the core-material charging nozzle into the core-material charging inlet of the core material container and charging the core material thereto;

stopping the air-release operation of the air-release means after the completion of the charging process; and stopping the suction operation of the suction means, thereby releasing the suction member from its adhered state onto the plate member.

11. The core-material charging method as set forth in claim 10, wherein:

the step for making the core material container adhere to the plate member and the positioning guide, further comprising a step of:

opening an air inlet and expanding the core material container by using air flowing thereinto through the air inlet.

12. The core-material charging method as set forth in claim 10, further comprising a step of:

opening an air inlet and removing and cleaning residual core material that adheres around the opening of the core-material charging nozzle and in the adjustable hole for incoming air of the core-material charging nozzle by introducing air through the air inlet after the completion of the charging process.

13. The core-material charging method as set forth in claim 10, wherein the steps are executed with predetermined time intervals.

14. The core-material charging method as set forth in claim 10, wherein adjustments of the charging density and the charging amount of the core material are carried out by setting the vacuum degree in the air release by the use of the air-release means.

15. The core-material charging method as set forth in claim 10, wherein a vacuum degree in the suction means is set to be greater to a predetermined extent than that in the air release of the air-release means.

16. The core-material charging device as set forth in claim 1, wherein the air-release means and suction means are sequentially operated such that the suction-means applies the second vacuum pressure before the air-release means applies the first vacuum pressure.

17. A charging method comprising the steps of:

housing a core material container on a positioning guide;

placing a plate member over the positioning guide and the core material container, the plate member having a plurality of air-vent pores;

combining upper and lower frames to form a sealed space, the positioning guide being located on the lower frame and the core material container being located within the sealed space;

sucking a portion of the core material container to adhere at least the portion of the core material container to the plate member;

releasing air contained in the sealed space and contained in the core material container through the air-vent pores and then through an outlet in the upper frame, the step of releasing air creating a vacuum in the sealed space and in the core material container and the step of releasing air occurring after the step of sucking;

charging core material into the core material container after the step of releasing air;

moving the core material through an opening provided in the plate member during the step of charging;

stopping the step of releasing air after completion of the step of charging core material; and stopping sucking of the portion of the core material container to thereby release the core material container from the plate member.

18. The charging method as set forth in claim 17, further comprising the step of inserting a core material charging nozzle into a core material charging inlet of the core material container before the step of charging core material, the core material charging inlet being surrounded by the portion of the core material container which is sucked and adhered to the plate member, the portion of the core material container which is sucked being non-air-permeable and the core material charging inlet being movable toward and away from the core material charging inlet.

19. The charging method as set forth in claim 17, further comprising the steps of providing an air inlet adjacent a charging nozzle provided for charging the core material and of opening the air inlet to remove and clean residual core material adhering around an opening of the charging nozzle, the air inlet being opened and air being introduced through the air inlet after completion of the step of charging core material.

20. The charging method as set forth in claim 17, further comprising the step of varying vacuum pressure within the sealed space to thereby vary charging density and charging amount of the core material in the core material container.

21. The charging method as set forth in claim 17, wherein a greater vacuum is provided in the step of sucking than in the step of releasing air contained in the sealed space and the core material container.

* * * * *